US006791047B1

(12) United States Patent
Skarlupka et al.

(10) Patent No.: US 6,791,047 B1
(45) **Date of Patent: *Sep. 14, 2004**

(54) TOGGLE SWITCH COVER APPARATUS AND METHOD

(75) Inventors: Michael J. Skarlupka, Freeport, IL (US); Brad L. Cummins, Freeport, IL (US); David S. Evans, Lena, IL (US)

(73) Assignee: Honeywell International Inc., Morristown, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/652,332

(22) Filed: Aug. 29, 2003

(51) Int. Cl.[7] ..... H01H 9/00
(52) U.S. Cl. ..... 200/335; 200/293
(58) Field of Search ..... 200/553, 293, 200/294, 296, 303, 307, 329, 332, 335, 339

(56) References Cited

U.S. PATENT DOCUMENTS

| | | | | | |
|---|---|---|---|---|---|
| 2,650,964 | A | * | 9/1953 | Razdow | 200/457 |
| 3,047,682 | A | * | 7/1962 | Hults | 200/16 A |
| 3,311,718 | A | * | 3/1967 | Allison et al. | 200/11 K |
| 4,191,387 | A | * | 3/1980 | Kirchoff | 200/302.3 |
| 4,370,528 | A | * | 1/1983 | Aschenbach | 200/6 BB |
| 4,758,724 | A | * | 7/1988 | Osika | 200/315 |
| 5,158,172 | A | | 10/1992 | Roeser et al. | 200/553 |
| 5,498,846 | A | | 3/1996 | Chin | 200/557 |
| 5,719,434 | A | * | 2/1998 | Levine et al. | 200/273 |
| 6,040,543 | A | | 3/2000 | Mina et al. | 200/559 |
| 6,160,227 | A | | 12/2000 | Singer | 200/43.14 |
| 6,392,170 | B1 | | 5/2002 | Wechsler | 200/43.21 |
| 6,420,669 | B1 | | 7/2002 | Shenker et al. | 200/339 |
| 2002/0170807 | A1 | | 11/2002 | Halphide | 200/43.16 |

* cited by examiner

*Primary Examiner*—Michael A. Friedhofer
(74) *Attorney, Agent, or Firm*—Kris T. Fredrick; Kermit D. Lopez; Luis M. Ortiz

(57) ABSTRACT

A toggle switch cover apparatus and method are disclosed, which includes a mounting nut and a bushing for a toggle switch, such that the bushing comprises a threaded area and an uppermost unthreaded area. The uppermost unthreaded area comprises a maximum outside diameter that is less than a corresponding minimum minor diameter of threads of the mounting nut. The mounting nut generally surrounds the uppermost unthreaded area of the bushing, such that a gap is formed between the mounting nut and the bushing, thereby promoting proper alignment of the toggle switch thereof and decreasing cross-threading issues.

20 Claims, 4 Drawing Sheets

TOGGLE SWITCH COVER APPARATUS AND METHOD

TECHNICAL FIELD

Embodiments are generally related to toggle switches. Embodiments are also related to toggle switch components, such as bushing and mounting nuts.

BACKGROUND OF THE INVENTION

A toggle switch is a switch in which a projecting lever with a spring can be utilized to open or to close an electric circuit. Toggle switches of various types have long been utilized to control power in domestic, commercial, industrial, and military applications for operating various electrical devices and equipment.

Known toggle switches typically are manufactured with a housing that contains electrical contacts and is fitted with a manually operable handle to switch power to externally mounted terminals. In one common form of a toggle switch, the handle has a cam surface internal to the housing that actuates a metallic leaf spring which in turn makes or breaks electrical conductivity with the contacts. Common toggle switches are standardized in terms of their mounting configurations such that they can readily be installed in wall-mounted electrical boxes, for example, with only the use of two screws. Typically, screw terminals are positioned on the sides of the switch housing such that connection can be easily made to electrical wires of suitable size to deliver power to electrical devices or equipment.

Toggle switches typically provide a manually accessible member which has metastability in a first position and a second position. For example, these positions may represent "ON" and "OFF". Some situations provide a substantial penalty for accidental actuation. For example, during repair or installation, accidental actuation may result in electrocution or shock. Therefore, where a worker is not in the immediate vicinity of a switch and is in the process of installation, repair or maintenance, often a lock or flag is placed to alert others that the switch should not be reset or to prevent resetting without significant efforts.

FIG. 1 is a perspective view of a conventional toggle switch 28. In FIG. 1, a toggle lever assembly 30 generally includes a toggle lever 32 that projects from a bushing 34 that is secured to a cover 36. The cover 36 is connected to a case 38. A number of terminals 40 can project from the case 38 to make external electrical connections that are to be switched by the toggle switch 28. Note that FIGS. 1 and 2 are described and illustrated herein for general background and edification purposes only and do not represent limiting features of the present invention, nor a limitation of any embodiments thereof.

FIG. 2 is a sectional side view of the conventional toggle switch 28, taken along section lines 2—2 of FIG. 1. In FIG. 2, the toggle lever 32 can be inserted in the bushing 34. A spherical section 46 of the toggle lever 32 generally rests an a spherical surface 48 of the bushing 34 and is held in place by a retaining ring 50 so that the toggle lever 32 pivots by sliding against the surface 48 and the retaining ring 50, which thus functions also as a bearing. The toggle lever 32, the bushing 34, the retaining ring 50, and the cover 36 when assembled comprise the toggle lever assembly 30.

In the alternative, the spherical section 46 may be pinned to the bushing 34 to support the toggle lever 32 and also provide support to rotate the toggle lever 32. The toggle lever assembly can be most readily assembled by connecting the bushing 34 to the cover 36. The toggle lever 32 can then be inserted into the bushing 34, and the retaining ring 50 (or a pin, if one is used) is placed to complete the assembly.

The toggle lever assembly 30 can be inserted into the case 38, where it is held in place by crimping the corners of the cover 36 to the case 38. A headed portion 52 may be rolled, glued, welded, swaged or otherwise shaped to secure the bushing 34 to the cover 36, which in turn is secured to the case 38 as described above.

A terminal 60 can be molded or otherwise inserted into the case 38 on one side and a terminal 62 is inserted correspondingly on the other side. The terminal 60 may include a shaped contact ball 64 that is inside the case 38 and a terminal pin 66 that is outside. Similarly, the terminal 62 includes a shaped contact ball 68 that is inside the case 38 and a terminal pin 70 that is outside.

A terminal 76, which is located between the terminals 60 and 62, has a terminal pin 78 that is outside the case 38. The terminal 76 is molded or otherwise inserted into the case 38 and is riveted, swaged, staked or the like to connect it to a blade 80. The blade 80 has a contact 82 that is placed opposite the shaped contact ball 64 and a contact 84 that is placed opposite the shaped contact ball 68. Such a switch generally establishes electrical contact between the terminal pins 66 and 78 by pressing the blade 80 to place the contact 82 against the shaped contact ball 64. Similarly, the electrical contact between the terminal pins 70 and 78 can be established by pressing the blade 80 to place the contact 84 against the shaped contact ball 68.

Each of these switching operations can be affected by rocking an actuator 86 in response to a force exerted by a plunger 88, which in turn is operated by an end 90 of the toggle lever 32. The spring action of the blade 80 provides a restoring force to open the switch by separating the contact 82 from the shaped contact ball 64 and the contact 84 from the shaped contact ball 68. It will be seen that the shape of the actuator 86 determines whether or not the action of the switch will be such as to maintain a selected position or to return from that position.

A coil spring 92 can be coaxial with and enclose the toggle lever 32 and may also be compressed by the spherical section 46 of the toggle lever 32 to force a tip 94 of the plunger 88 against the actuator 86. The fact that the coil spring 92 surrounds the toggle lever 32 allows the coil spring 92 to be larger in coiled diameter and thus sturdier than it would be if it were sized for insertion into the toggle lever 32.

Thus, conventional toggle switches, such as the example illustrated and described above with respect to FIGS. 1 and 2 utilize a threaded bushing and mounting nut to secure the device to a fixture or panel. One of the primary problems with such toggle switches, is that it is every easy to cross-thread the mounting nut during installation, thereby rendering the toggle switch useless.

BRIEF SUMMARY OF THE INVENTION

The following summary of the invention is provided to facilitate an understanding of some of the innovative features unique to the present invention and is not intended to be a full description. A full appreciation of the various aspects of the invention can be gained by taking the entire specification, claims, drawings, and abstract as a whole.

It is, therefore, one aspect of the present invention to provide an improved toggle switch apparatus and method.

It is another aspect of the present invention to provide for an improved cover for a toggle switch.

It is yet a further aspect of the present invention to ensure proper alignment of a toggle switch and components thereof.

It is an additional aspect of the present invention to prevent cross threading due to misalignment of toggle switch components.

The aforementioned aspects of the invention and other objectives and advantages can now be achieved as described herein. A toggle switch cover apparatus and method are disclosed, which includes a mounting nut and a bushing for a toggle switch, such that the bushing comprises a threaded area and an uppermost unthreaded area. The uppermost unthreaded area comprises a maximum outside diameter that is less than a corresponding minimum minor diameter of threads of the mounting nut. The unthreaded portion or unthreaded area is generally located between the uppermost area of the bushing and the mounting nut, thereby promoting proper alignment of the toggle switch thereof and decreasing cross-threading issues. The toggle switch itself can include a toggle, wherein a portion of the toggle is surrounded by the mounting nut and the bushing. The mounting nut is positionable on the bushing in the uppermost unthreaded area thereof in a plane perpendicular to an axis of the bushing prior to a threading of the mounting nut onto the bushing. The bushing r comprises a plurality of threads for engaging corresponding mating threads of the mounting nut.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION OF THE INVENTION

The particular values and configurations discussed in these non-limiting examples can be varied and are cited merely to illustrate at least one embodiment of the present invention and are not intended to limit the scope of the invention.

Figure 1:
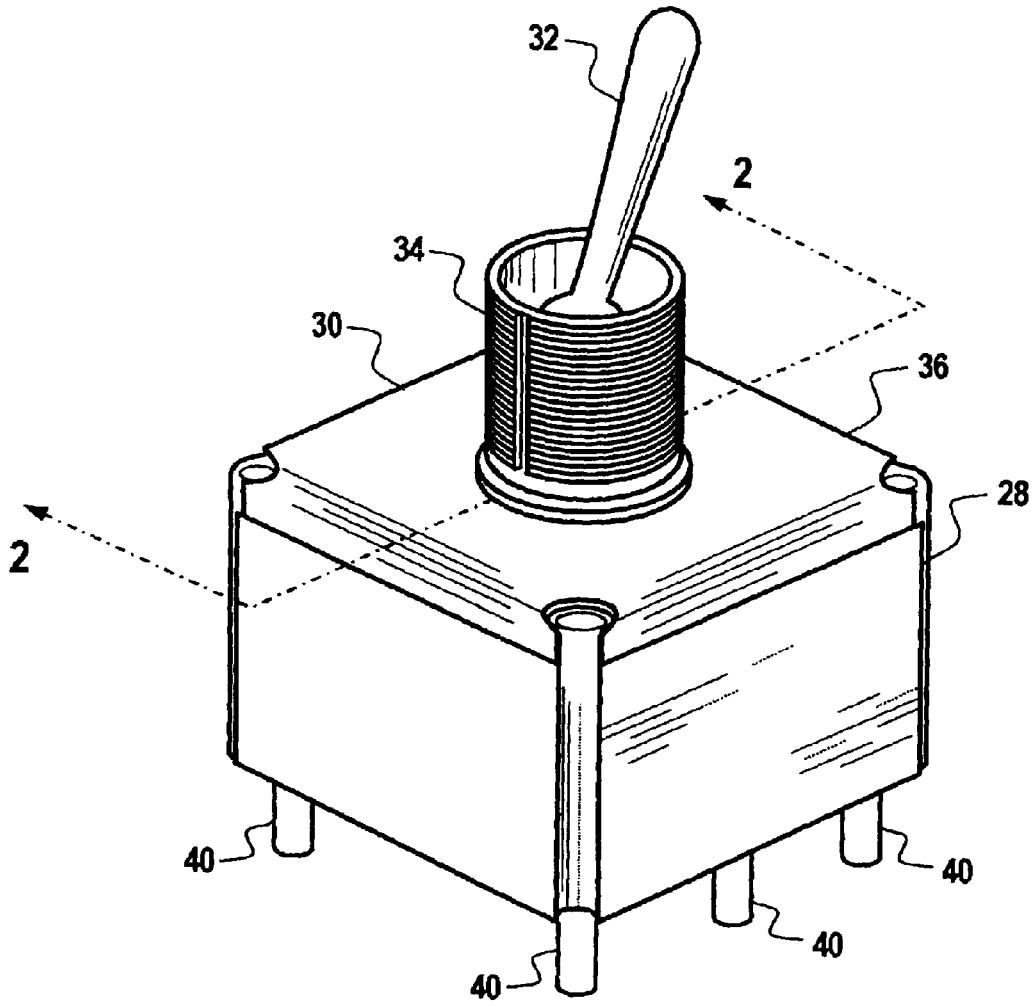
Fig. 1 (Prior Art)
FIG. 1 illustrates a perspective view of a conventional toggle switch.
Figure 2:
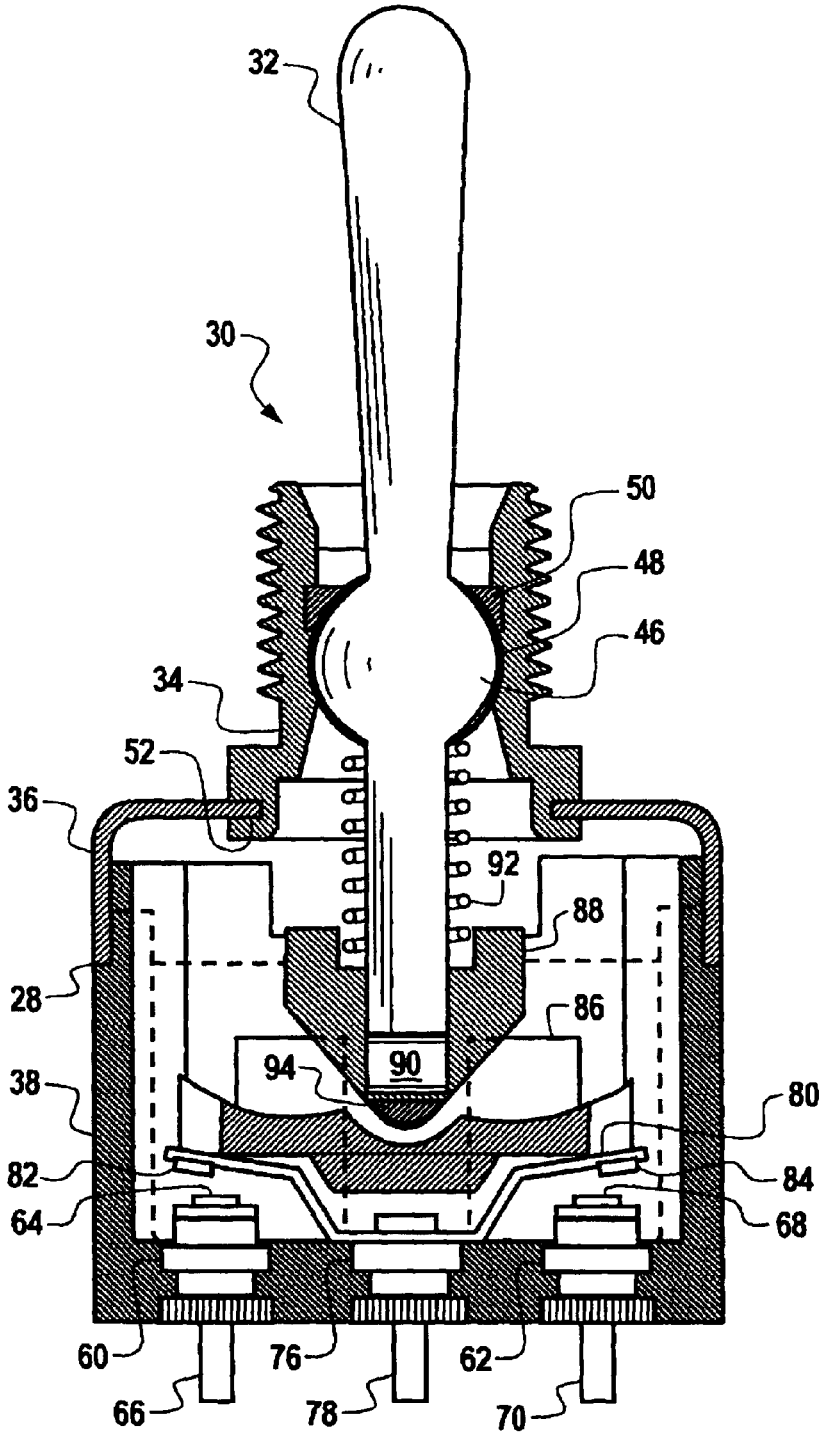
Fig. 2 (Prior Art)
FIG. 2 illustrates a sectional side view of the conventional toggle switch of FIG. 1, taken along section lines 2—2 of FIG. 1.
Figure 3:
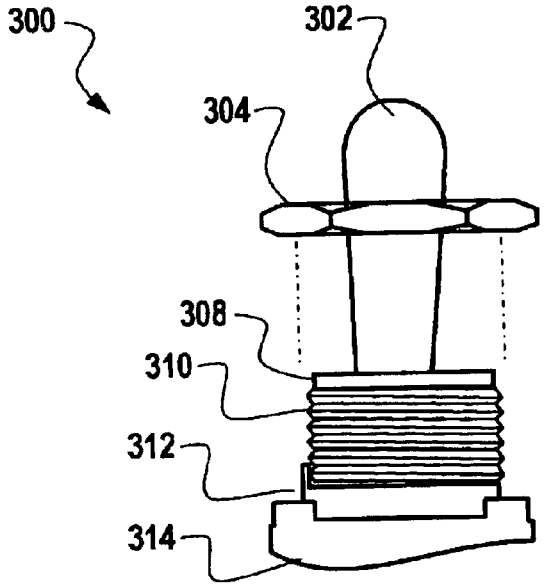
FIG. 3 illustrates a toggle switch having an easy start thread feature, in accordance with an embodiment of the present invention.
Figure 4:
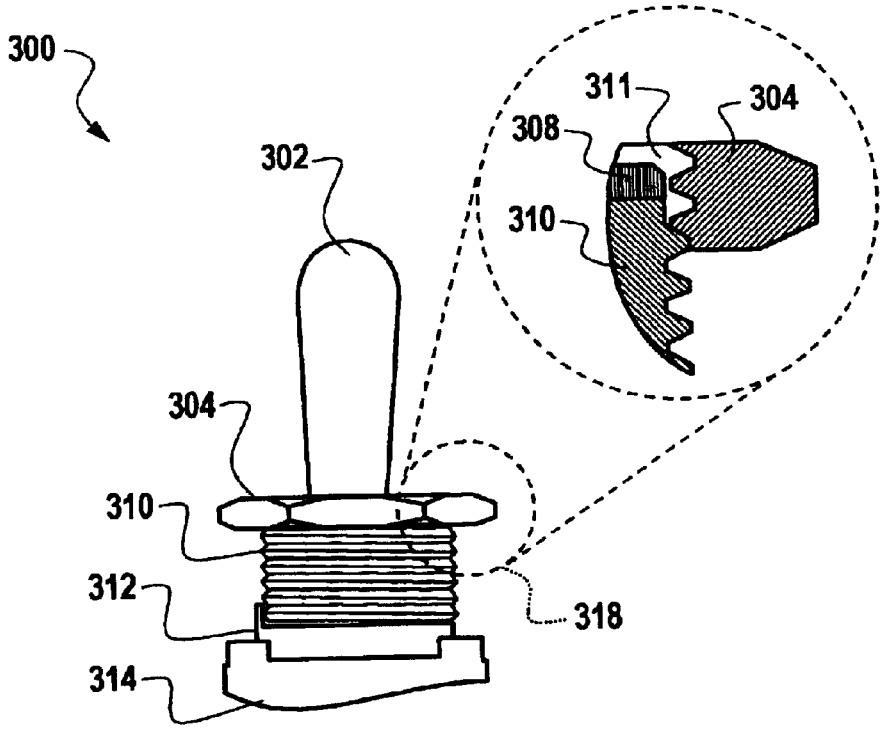
FIG. 4 illustrates a detailed view of a section of a mounting nut adapted for use with the toggle switch depicted in FIG. 3, in accordance with an embodiment of the present invention.

Turning now to FIG. 31 a toggle switch 300 having an "easy start" thread feature is illustrated in accordance with an embodiment of the present invention. FIG. 4 illustrates a detailed view of a section of a mounting nut adapted for use with the toggle switch 300 depicted in FIG. 3, in accordance with an embodiment of the present invention. Note that in FIGS. 3 and 4, identical parts are indicated by identical reference numerals. Thus, toggle switch 300 includes a bushing 310 positioned above a base portion 312, which in turn is located above a supporting portion 314. Toggle switch 300 is also configured such that an uppermost unthreaded area lead-in portion 308 (i.e., lead-in portion) is located at an uppermost area of bushing 310. The bushing 310 is shown in juxtaposition to a mounting nut 304 via detail 318 of FIG. 4. A gap 311 is shown in detail 318 between mounting nut 304 and bushing 310.

The mounting nut 304 can be positioned above the uppermost-unthreaded area 308 while also surrounding toggle 302. The uppermost-unthreaded area 308 generally possesses a maximum outside diameter that is less than the corresponding minimum minor diameter of the threads of the mounting nut 304. This configuration permits the mounting nut 304 to be easily positioned on and/or over the threaded bushing 310. Such a configuration provides for an easy alignment of the mounting nut 304 and can significantly reduce the possibility for cross-threading of the mounting nut 304 onto the bushing 310. Area 318 is shown in greater detail in FIG. 4. A cross-sectional view of detail 318 illustrates a portion of the threaded bushing 310 along with a portion of the upper-most unthreaded area 308 in association with mounting nut 304.

Once the mounting nut 304 is positioned in this location, simply rotating the mounting nut 304 can successfully engage the threads of mounting nut 304 with corresponding mating threads of the switch cover bushing 310. This feature not only contributes to easier hand mounting of the switch 300, but also is especially beneficial when using power equipment to fasten the mounting nut 304 to the bushing 310 because improper alignment can result in a rapid case of cross-threading, thereby rending a toggle switch useless.

The bushing 310 may be configured in a variety of sizes. For example, the bushing 310 can be configured with a diameter in a range of ¼ inches to 15⁄32 inches, depending upon design considerations. It can be appreciated, of course, that the range of ¼ inches to 15⁄32 inches is merely a suggested range, and that other diameter ranges, smaller or large, can be implemented in accordance with alternative embodiments. Additionally, the length of the unthreaded area 308 can be varied depending upon the size of mounting nut 304. For example, the length of the unthreaded area 308 can be approximately 0.04000 inches. Again, it can be appreciated that this value is merely a suggested length and that other lengths can also be implemented in accordance with alternative embodiments.

Toggle switch 300 may also be configured as a 2-position momentary and/or maintained actions switch, again, depending upon design and implementation considerations. Toggle switch 300 can also be implemented as a 2 or 3 position switch, in accordance with alternative embodiments, or can be configured with a standard toggle 302. Note that toggle 302 may also be positioned in the shape of a tab level or a pull-to-unlock lever, depending upon design considerations. As a guard against accidental operation, pull-to-unlock levers are generally pulled to change positions. A splash-type lever-to-bushing seal can also be provided to help prevent the entrance of moisture and dust into the internal components of toggle switch 300.

Figure 5:
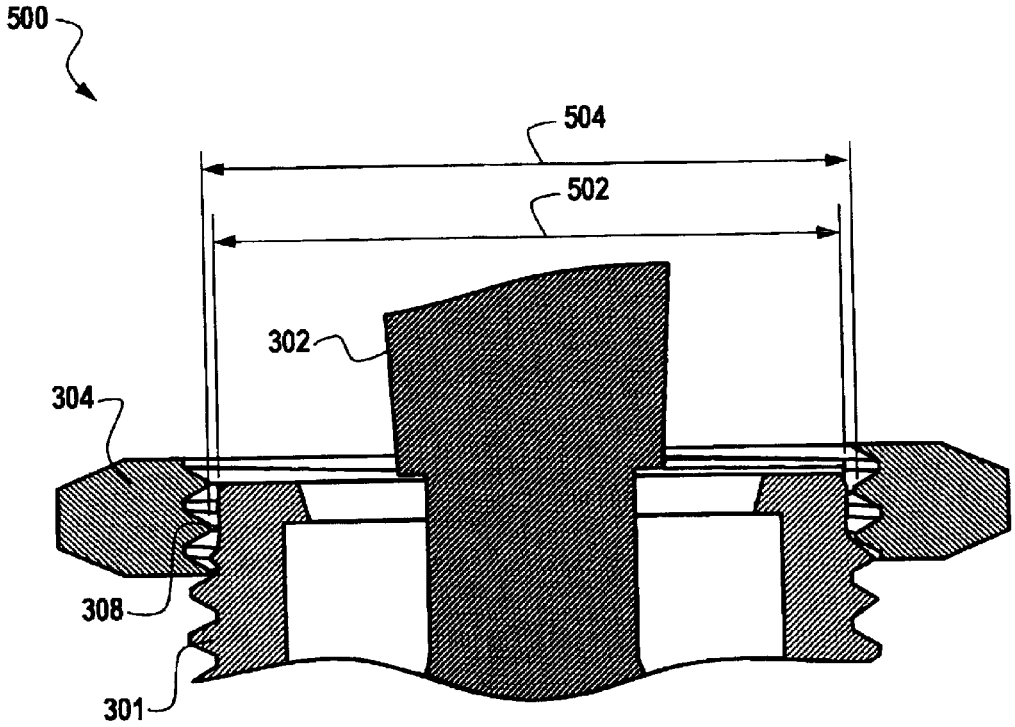
FIG. 5 illustrates a side sectional view of the minimum minor diameter of a mounting nut and maximum outside diameter of an unthreaded lead-in portion of a bushing, in accordance with an embodiment of the present invention

FIG. 5 illustrates a side sectional view 500 of a minimum minor diameter 504 of the mounting nut 304 and a maximum outside diameter 502 of the unthreaded lead-in portion 308 of bushing 310, in accordance with an embodiment of the present invention. Note that in FIGS. 3, 4, and 5, analogous or identical parts or elements are indicated by identical reference numerals. Thus, as depicted in sectional view 500 of FIG. 5, bushing 310, which can be adapted for use with a toggle switch, includes both a threaded area an uppermost unthreaded area 308, such that the uppermost unthreaded area or lead-in portion 308 comprises a maximum outside diameter 302 that is less than a corresponding minimum minor diameter 504 of mounting nut 304

The embodiments and examples set forth herein are presented to best explain the present invention and its practical application and to thereby enable those skilled in the art to make and utilize the invention. Those skilled in the art, however, will recognize that the foregoing description and examples have been presented for the purpose of illustration and example only. Other variations and modifications of the present invention will be apparent to those of skill in the art, and it is the intent of the appended claims that such variations and modifications be covered.

The description as set forth is not intended to be exhaustive or to limit the scope of the invention. Many modifications and variations are possible in light of the above teaching without departing from the scope of the following claims. It is contemplated that the use of the present invention can involve components having different characteristics. It is intended that the scope of the present invention be defined by the claims appended hereto, giving full cognizance to equivalents in all respects.

What is claimed is:

1. A toggle switch cover apparatus, comprising:

a bushing for a toggle switch, wherein said bushing comprises a threaded area and an uppermost unthreaded area, wherein said uppermost unthreaded area comprises a maximum outside diameter that is less than a corresponding minor diameter of threads of a mounting nut; and said mounting nut surrounding said uppermost unthreaded area of said bushing, wherein a gap is formed between said mounting nut and said bushing, thereby promoting proper alignment of said toggle switch thereof and decreasing cross-threading issues.

2. The apparatus of claim 1 wherein said toggle switch further comprises a toggle, wherein a portion of said toggle is surrounded by said mounting nut and said bushing.

3. The apparatus of claim 2 wherein said bushing is positioned above a base portion, wherein said base portion is located above a supporting portion.

4. The apparatus of claim 2 wherein said uppermost unthreaded area comprises a lead-in portion.

5. The apparatus of claim 1 wherein said mounting nut is positionable on said bushing in said uppermost unthreaded area thereof in a plane perpendicular to an axis of said bushing prior to a threading of said mounting nut onto said bushing.

6. The apparatus of claim 1 wherein said bushing comprises a plurality of threads for engaging corresponding mating threads of said mounting nut.

7. The apparatus of claim 1 wherein said corresponding minor diameter of threads of said mounting nut comprises a minimum minor diameter of said threads of said mounting nut.

8. The apparatus of claim 1 wherein said mounting nut is positionable over said bushing.

9. The apparatus of claim 1 wherein a length of said uppermost unthreaded area depends upon a size of said mounting nut.

10. A toggle switch cover apparatus, comprising:

a toggle switch comprising a toggle;

a bushing associated with said toggle switch, wherein said bushing comprises a threaded area and an uppermost unthreaded area, wherein said uppermost unthreaded area comprises a maximum outside diameter that is less than a corresponding minimum minor diameter of threads of a mounting nut;

said mounting nut surrounding said uppermost unthreaded area of said bushing, wherein a gap is formed between said mounting nut and said bushing and a portion of said toggle is surrounded by said mounting nut and said bushing; and wherein said mounting nut is positionable on said bushing in said uppermost unthreaded area thereof in a plane perpendicular to an axis of said bushing prior to a threading of said mounting nut onto said bushing, thereby promoting proper alignment of said toggle switch thereof and decreasing cross-threading issues.

11. A toggle switch cover method, comprising:

providing a bushing for a toggle switch, wherein said bushing comprises a threaded area and an uppermost unthreaded area, wherein said uppermost unthreaded area comprises a maximum outside diameter that is less than a corresponding minor diameter of threads of a mounting nut; and locating said mounting nut about said uppermost unthreaded area of said bushing, wherein a gap is formed between said mounting nut and said bushing, thereby promoting proper alignment of said toggle switch thereof and decreasing cross-threading issues.

12. The method of claim 11 wherein said toggle switch further comprises a toggle, wherein a portion of said toggle is surrounded by said mounting nut and said bushing.

13. The method of claim 11 further comprising the step of positioning said mounting nut on said bushing in said uppermost unthreaded area thereof in a plane perpendicular to an axis of said bushing prior to a threading of said mounting nut onto said bushing.

14. The method of claim 11 further comprising the step of configuring said bushing to comprise a plurality of threads for engaging corresponding mating threads of said mounting nut.

15. The method of claim 11 wherein said corresponding minor diameter of threads of said mounting nut comprises a minimum minor diameter of said threads of said mounting nut.

16. The method of claim 12 further comprising the steps of positioning said bushing above a base portion, wherein said base portion is located above a supporting portion.

17. The method of claim 12 wherein said uppermost unthreaded area comprises a lead-in portion.

18. The method of claim 11 further comprising the step of positioning said mounting nut over said bushing.

19. The method of claim 11 wherein a length of said uppermost unthreaded area depends upon a size of said mounting nut.

20. The method of claim 11 further comprising the step of configuring said bushing to comprise a diameter in a range of at least ¼ inches to 15/32 inches.

* * * * *